US007513540B2

(12) United States Patent
Hagemeyer et al.

(10) Patent No.: US 7,513,540 B2
(45) Date of Patent: Apr. 7, 2009

(54) INACTIVE DOOR BOLT

(75) Inventors: Bruce A. Hagemeyer, Pella, IA (US); Fredrick L. Hrdlicka, Pella, IA (US); Gary E. Tagtow, Pella, IA (US); Chad Swier, Sioux Falls, SD (US); Daniel L. Raap, Hartford, SD (US)

(73) Assignees: Pella Corporation, Pella, IA (US); Amesbury Group, Inc., Sioux Falls, SD (US)

( * ) Notice: Subject to any disclaimer, the term of this patent is extended or adjusted under 35 U.S.C. 154(b) by 349 days.

(21) Appl. No.: 11/102,917

(22) Filed: Apr. 8, 2005

(65) Prior Publication Data

US 2006/0150516 A1 Jul. 13, 2006

Related U.S. Application Data

(60) Provisional application No. 60/642,814, filed on Jan. 11, 2005.

(51) Int. Cl.
*E05C 1/06* (2006.01)

(52) U.S. Cl. ..... 292/38; 292/156; 292/157; 292/DIG. 21; 292/341.15

(58) Field of Classification Search ..... 292/38, 292/8, 10, 16, 32, 33, 35, 36, 41, 156 X, 157 X, 292/158, 162, 168, 174, 138, 139, DIG. 21 X, 292/341.15, 341.19; 70/108, 103, 130
See application file for complete search history.

(56) References Cited

U.S. PATENT DOCUMENTS

| | | | | | |
|---|---|---|---|---|---|
| 932,220 | A | * | 8/1909 | Winkley | 12/33.8 |
| 1,051,918 | A | * | 2/1913 | Rowley | 292/7 |
| 2,202,916 | A | * | 6/1940 | Mussa | 292/177 |
| 3,649,060 | A | * | 3/1972 | Ruff | 292/42 |
| 4,099,753 | A | * | 7/1978 | Gwozdz et al. | 292/177 |
| 4,283,882 | A | | 8/1981 | Hubbard et al. | |
| 4,643,005 | A | * | 2/1987 | Logas | 70/95 |
| 4,644,696 | A | | 2/1987 | Bursk | |
| 5,005,881 | A | * | 4/1991 | Bailey et al. | 292/45 |
| 5,024,472 | A | | 6/1991 | Cohrs | |
| 5,076,620 | A | | 12/1991 | Campbell et al. | |
| 5,901,989 | A | * | 5/1999 | Becken et al. | 292/35 |
| D429,619 | S | | 8/2000 | Monts de Oca | |
| D438,445 | S | | 3/2001 | Monts de Oca | |
| 6,217,087 | B1 | | 4/2001 | Fuller | |
| 6,324,876 | B1 | | 12/2001 | Prevot et al. | |
| 6,409,231 | B1 | | 6/2002 | Rusiana | |

(Continued)

*Primary Examiner*—Carlos Lugo
*Assistant Examiner*—Mark Williams
(74) *Attorney, Agent, or Firm*—Faegre & Benson LLP

(57) ABSTRACT

The present invention includes an apparatus for an active/inactive door system wherein an inactive door lock prevents the locking of an active door lock unless the inactive door lock is first engaged in a locking position. The active door lock includes a dead bolt and a lever for extensible locking engagement with a strike plate on the inactive door. The inactive door lock includes an upper and lower shoot bolt lock, each shoot bolt include a spring lever. Each spring lever is selectably biased against a back side of the strike plate in a first or second detent. The first detent is positioned on the strike plate such that when the corresponding spring lever is biased against in the first detent against a back side of the strike plate the corresponding dead bolt or latch bolt cannot be extended into engagement with the strike plate in a locking position.

23 Claims, 13 Drawing Sheets

U.S. PATENT DOCUMENTS 6,457,751 B1 * 10/2002 Hartman ..... 292/137
6,491,326 B1 12/2002 Massey et al.
2004/0066046 A1 4/2004 Becken

* cited by examiner

INACTIVE DOOR BOLT

This application claims the benefit of U.S. provisional application Ser. No. 60/642,814, entitled INACTIVE DOOR BOLT, filed Jan. 11, 2005, which is hereby incorporated by reference.

FIELD OF INVENTION

The present invention relates generally to a door lock. More specifically, the present invention relates to double hinged doors wherein the inactive door has an inactive door lock that does not allow the active door lock to be engaged in a locked position unless the inactive door lock is engaged in a locked position.

BACKGROUND OF THE INVENTION

Many patio or other entryways utilize a two-door configuration that meets in the middle of the doorway. When a two-door configuration is used, whether as two swinging or two sliding doors, one door is referred to as the active door and the other is referred to as the inactive door. The active door is the door that is normally utilized when going through the doorway. In other words, the door that opens when an operating handle is turned. The inactive door is the door that generally remains closed or locked except for circumstances where a wider entryway is needed. Generally, the doors are mounted on a frame by a set of hinges for swinging door applications or on a track for sliding door applications.

The primary locking mechanism used to lock the inactive door is usually a shoot bolt. The shoot bolt is a bolt, elongated rod, or other mechanism that extends from the inactive door in an up and down direction into the frame and/or floor surrounding the door. The shoot bolt may be attached to the interior face of the door or to a side edge of the door. The inactive door also includes a strike plate positioned to receive a latch bolt from the active door to maintain both doors in a closed condition. A handle, thumbscrew, lever, and/or key assembly attached to the latch bolt manually controls the latch bolt and enables the door to be opened or closed. A retractable dead bolt operated by a thumbturn or the like is frequently associated with the latch bolt to provide extra locking security to the doors. The use of dual dead bolt locks has increasingly become the standard in that two locks provide even greater security than one.

The shoot bolt is a sturdy and reliable locking mechanism to secure two door configurations. The shoot bolt, however, requires an additional step to lock that can be ignored by the user. In many cases the shoot bolt may not be engaged because of a hurried user or by simple neglect.

BRIEF SUMMARY OF THE INVENTION

The present invention may include a shoot bolt lock assembly for a set of active/inactive double doors that prevents the active door from being locked unless the shoot bolt lock assembly of the inactive door is engaged in a locked position.

The present invention further includes a lock assembly for a set of active/inactive double doors wherein the strike plate slot is blocked when the shoot bolts of the inactive door are not engaged in a locked position.

The present invention further includes a lock assembly for a set of active/inactive panel doors wherein one or both of the latch bolt or dead bolt cannot be engaged to lock the door assembly unless the corresponding shoot bolts of the inactive panel door are engaged in the locked position.

The present invention is a flush bolt assembly that consists of two shoot shafts and shoot tips. The shoot shafts include attachment spacers with screw sleeves, detents, an aesthetic sleeve, and levers. The shoot shafts have slots in them that help keep the correct spacing and travel, help to locate the screw sleeves, and also allows for attachment to the panel. The attachment spacers prevent the shaft from falling and also allow for indication that the shaft is in place. The levers are located at the strike plate. To unlock or lock the mechanisms, the levers are moved up or down. When the mechanism is unlocked, the levers are centered in the strike plate slots and the active door can not be locked.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
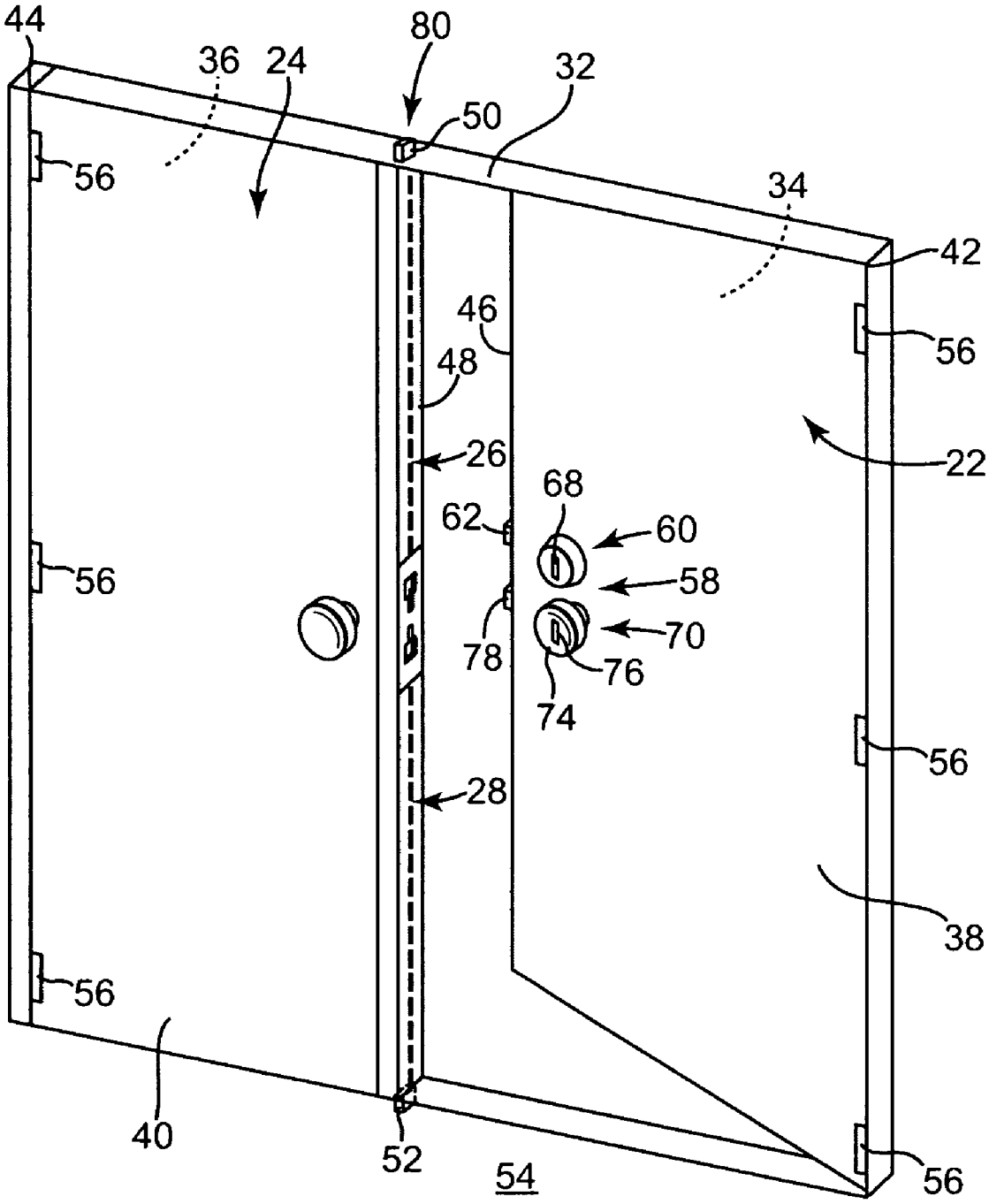
FIG. 1 is a perspective view of a double door assembly including an active and inactive door.

The present invention is a lock system 20 for a double door set that includes an active door 22 and an inactive door 24. The lock system 20 may include an inactive door lock 80 that includes an upper shoot bolt lock 26 and lower shoot bolt lock 28 (or flush bolt lock) mounted on the inactive door 24. The lock system may also include an active door lock 58. The lock system 20 may prevent the active panel 22 from being locked until both the upper and lower shoot bolt locks 26 and 28 are operatively engaged into the locked position.

As illustrated in FIG. 1, one embodiment of the present invention lock system 20 may include a pair of doors 22 and 24 mounted in an entrance frame 32 for inward opening. The inactive door lock 80 includes the upper shoot bolt lock 26 and the lower shoot bolt lock 28. The active and inactive doors 22 and 24 may be pivotally supported for individual opening and closing movement. The active and inactive doors 22 and 24 may include an interior face 34 and 36, an exterior face 38 and 40, a pivot point 42 and 44, and a side edge 46 and 48, respectively. The frame 32 may include two, three, or four sides. The frame may also include an upper locking point 50 and a lower locking point 52. In further embodiments, the locking points 50 and 52 may extend beyond the frame 32, for example, into a floor 54. The active and inactive doors 22 and 24 may also include a plurality of hinges 56 that engage the frame 32. When both of the doors 22 and 24 are closed, the interior faces 34 and 36 and exterior faces 38 and 40 of each door 22 and 24 may be in a common plane.

Moreover, an astragal or style (not shown) may be mounted to the inactive door 24 or between the active and inactive doors 22 and 24. An astragal may be made of wood, metal, or other materials, and may include a generally T-shaped cross section to provide a vertical stop against which the active door 22 can close.

In other embodiments, the doors 22 and 24 may swing in or out and may in some cases be sliding doors. The lock system 20 of the present invention may be attached to the inactive door 24, astragal or styles to a portion of the frame, or in any other manner without changing the nature and scope of the present invention.

The active door lock 58 may be any standard lock mechanism known to those skilled in the art. In general, such an active door lock 58 may include a dead bolt lock 60 including a dead bolt 62, a thumb latch 64 (not shown), a strike plate 30, and a key interface 68. The thumb latch 64 may be positioned on the interior face 34 of the active door 22 and the key interface 68 positioned on the exterior face 38. When the doors 22 and 24 are in a closed position, the dead bolt 62 may be extended to engage strike plate 30 of the inactive door 24 or retracted from engagement by either the thumb latch 64 or the key interface 68. The strike plate 30 may be mounted on the side edge 48 of the inactive door 24. Normally such a dead bolt 62 is not biased towards the extended or retracted position. The active door lock 58 may also include a latch bolt lock 70 that includes an interior handle 72 (not shown) and an exterior handle 74, a key interface 76 on the exterior handle 74, and a latch 78. The latch 78 for the latch bolt lock 70 is normally biased toward the extended position to automatically engage the inactive door 24. Either door handle 22 and 24 may be moved to disengage the latch 78. In the present embodiment, the latch bolt lock 70 engages the same strike plate 30 as the deadbolt lock 60. As may be appreciated, the active door lock 58 may include any number of features and may be any number of shapes or sizes, and may be installed to the active door a variety of ways, without changing the nature and scope of the present invention. In one alternative embodiment, the active door lock may also include a shoot bolt or flush bolt mechanism that engages corresponding strike plates engaged in the frame (on the head and sill). This shoot bolt mechanism may be activated from the center of the active door or may include lever engagement means located near the top and the bottom of the active door.

Figure 2:
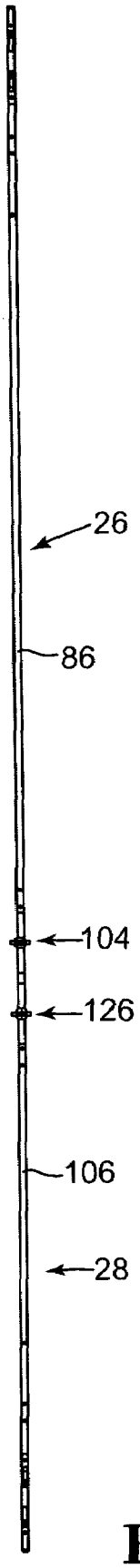
FIG. 2 is a top plan view of an upper shoot and a lower shoot bolt of the present invention.
Figure 4A:
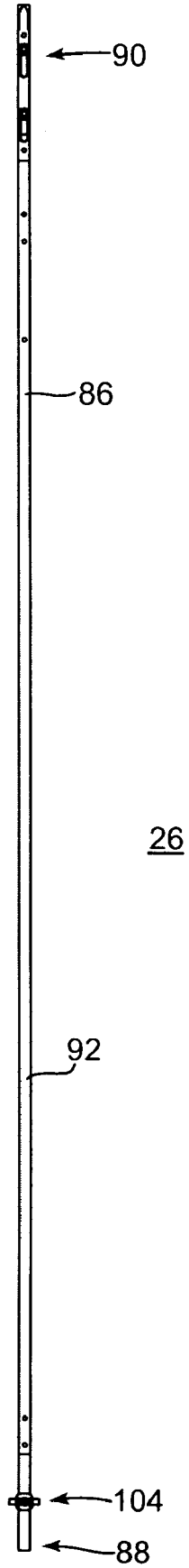
FIG. 4A is a top plan view of the upper shoot bolt of FIG. 2.
Figure 4B:
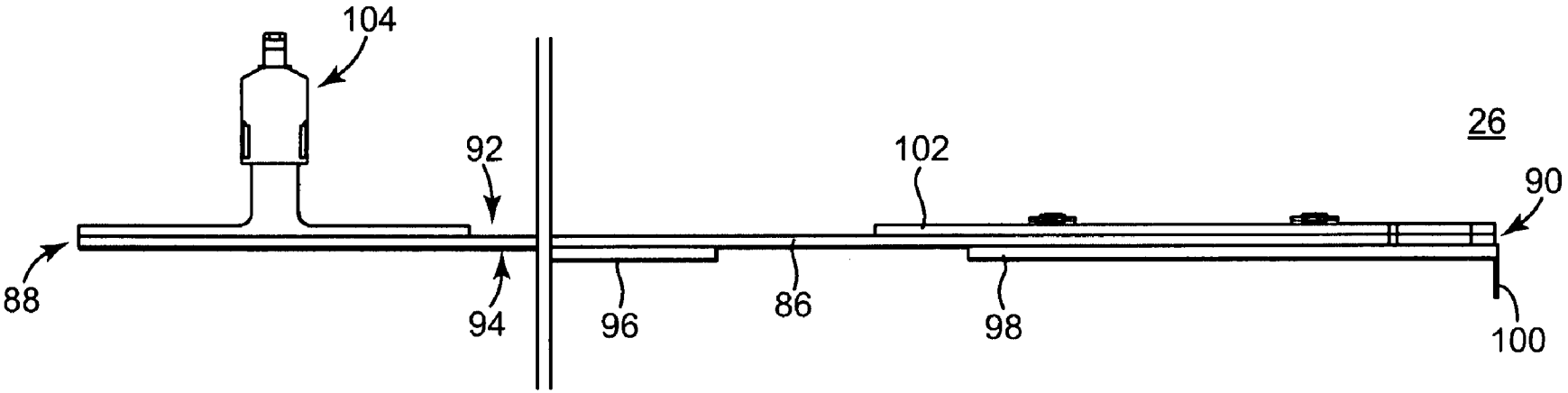
FIG. 4B is a side plan view of the lower shoot bolt of FIG. 2.

As illustrated in FIG. 2, the inactive door lock 80 may be comprised of an upper shoot bolt lock 26 and a lower shoot bolt lock 28. The upper shoot bolt lock 26, illustrated in FIGS. 4 and 5, may include an upper shoot bolt 86 (or flush bolt) including a proximal end 88 and a distal end 90 and a first face 92 and a second face 94. (Proximal is defined herein as being near the center of the door where the door handle is normally situated). The upper shoot bolt 86 may further include a plurality of spacers. A first spacer 96 may be fixedly attached to the second face 94 of the upper shoot bolt 86. A second spacer 98 also may be slidingly positioned on the second face 94 of the upper shoot bolt 86. In the present embodiment, the second spacer 98 may further include a locator 100. The distal end 90 of the upper shoot bolt 86 may further include a shoot tip 102 fixedly attached to the upper shoot bolt 86. The upper shoot bolt lock 26 may also include a spring lever 104. The spring lever 104 may be secured to the proximal end 88 of the upper shoot bolt 86 and extend generally perpendicular to the first face 92. The spring lever 104 is further described below.

Figure 3A:
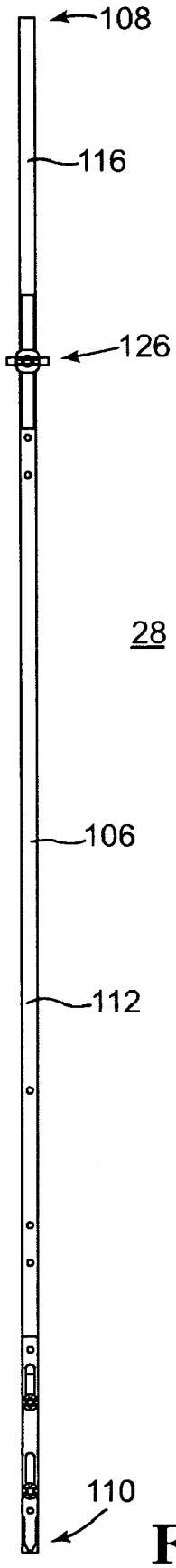
FIG. 3A is a top plan view of the lower shoot bolt of FIG. 2.
Figure 3B:
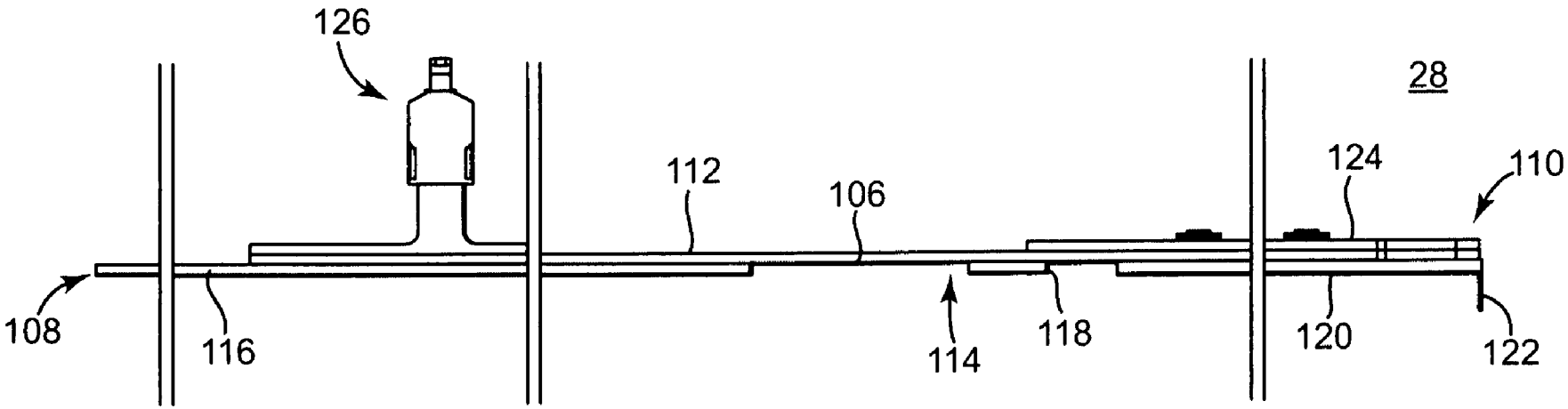
FIG. 3B is a side plan view of the lower shoot bolt of FIG. 2.
Figure 5:
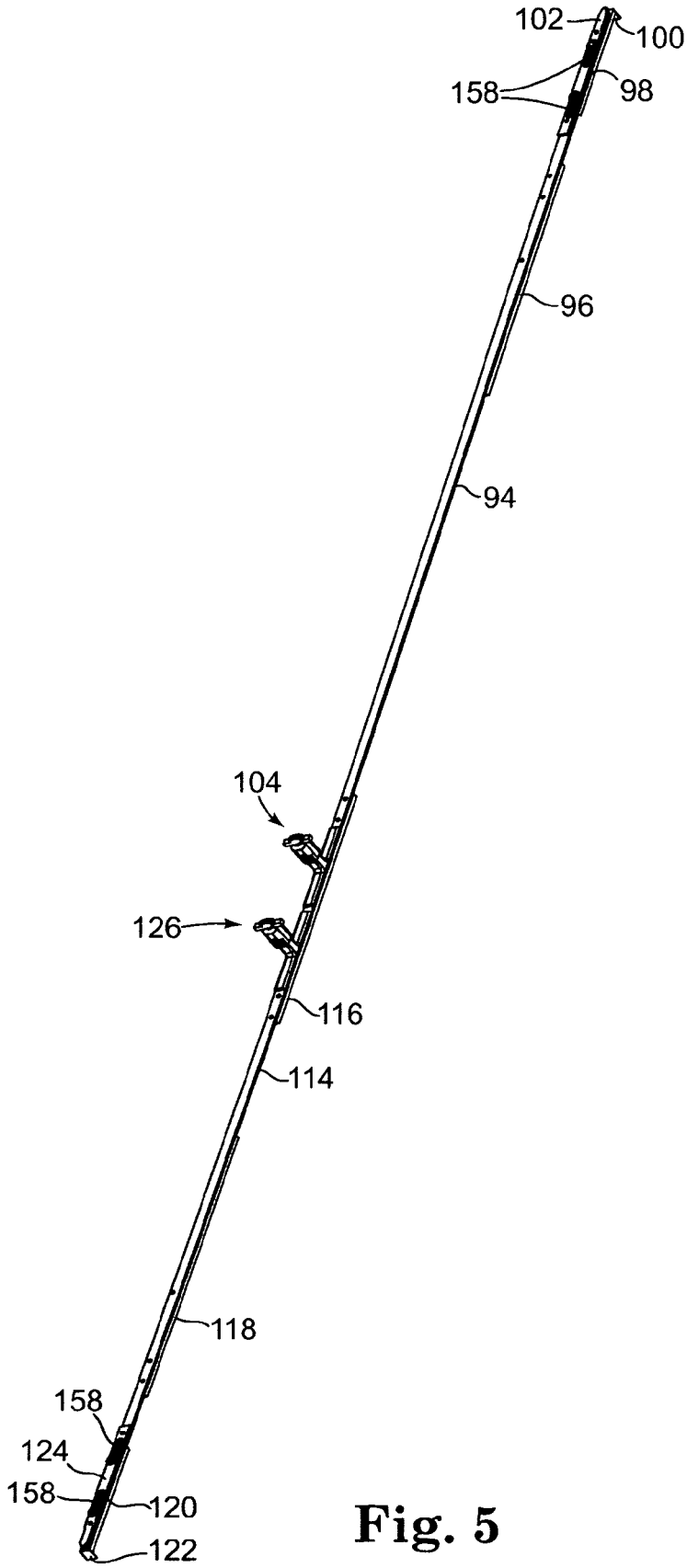
FIG. 5 is a perspective view of the upper and lower shoot bolt of FIG. 2.
Figure 6A:
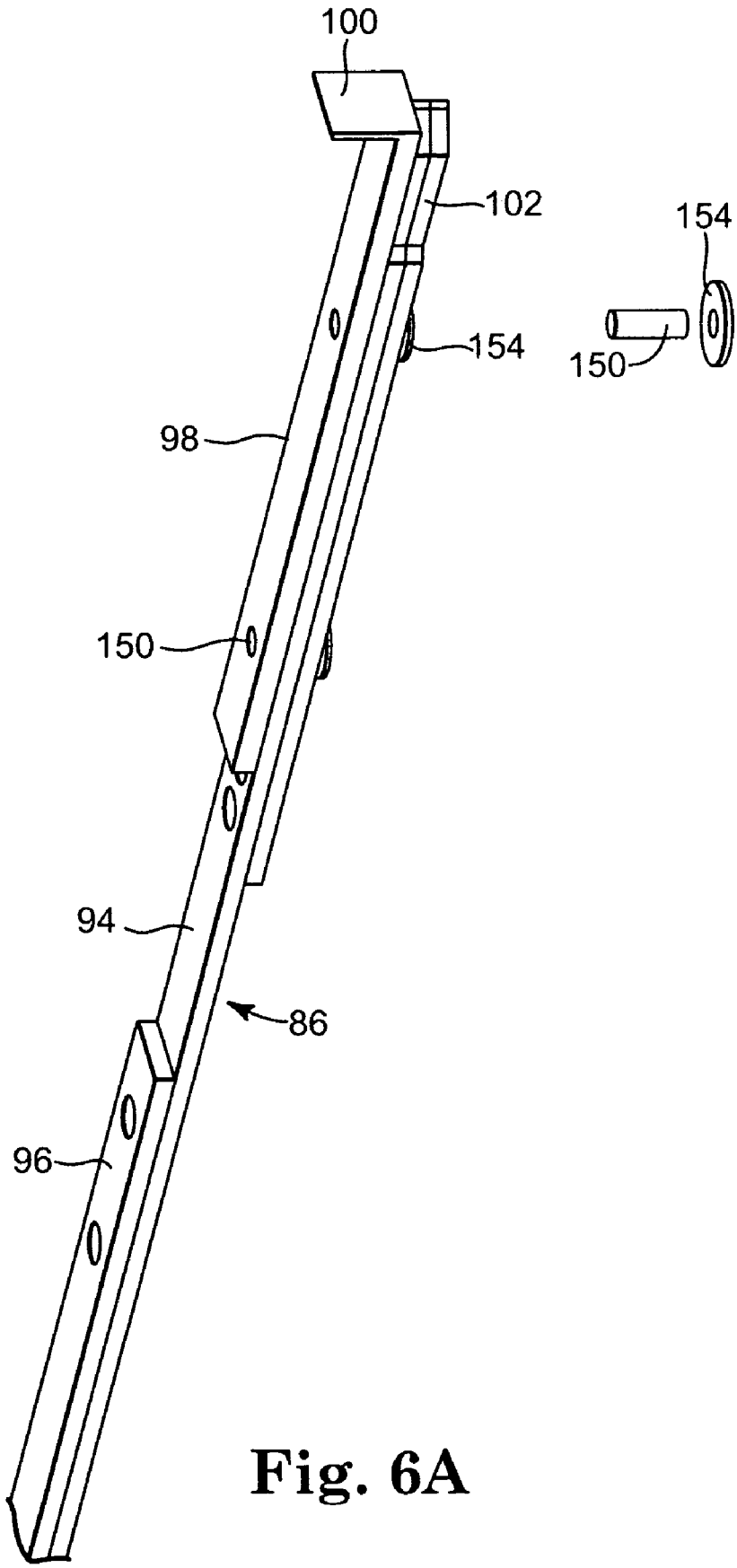
FIG. 6A is a perspective view of a distal end of the shoot bolt of FIG. 3A.
Figure 6B:
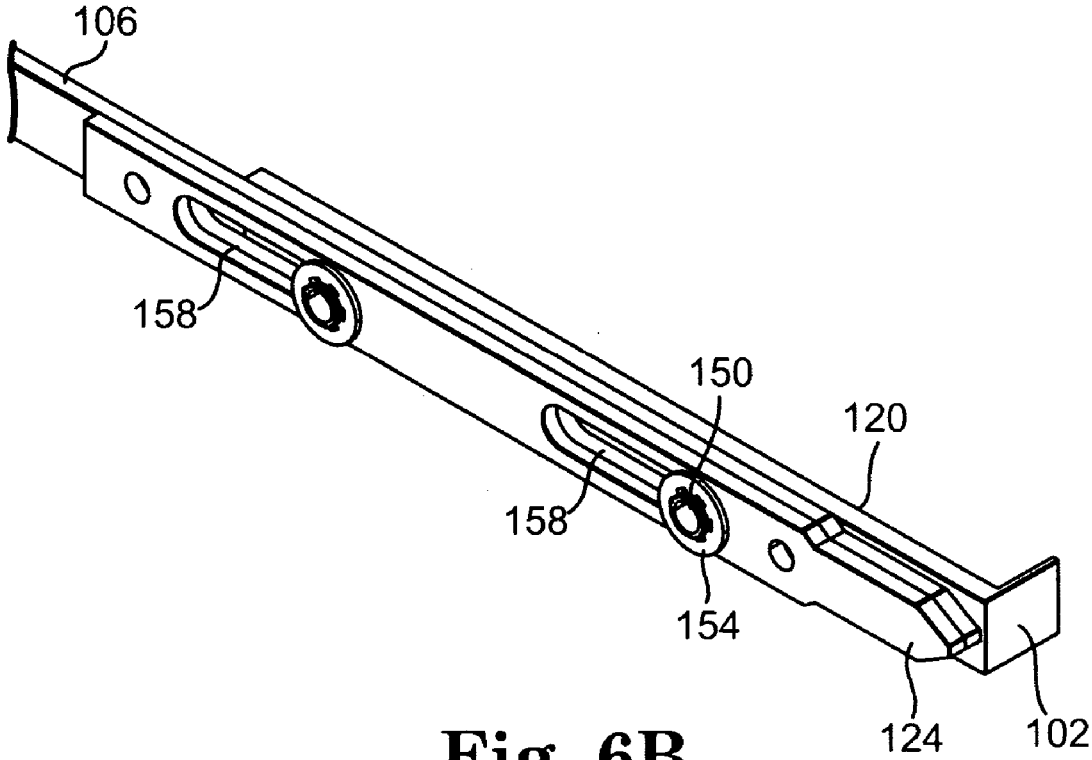
FIG. 6B is another perspective view of the distal end of FIG. 6A.
Figure 6C:
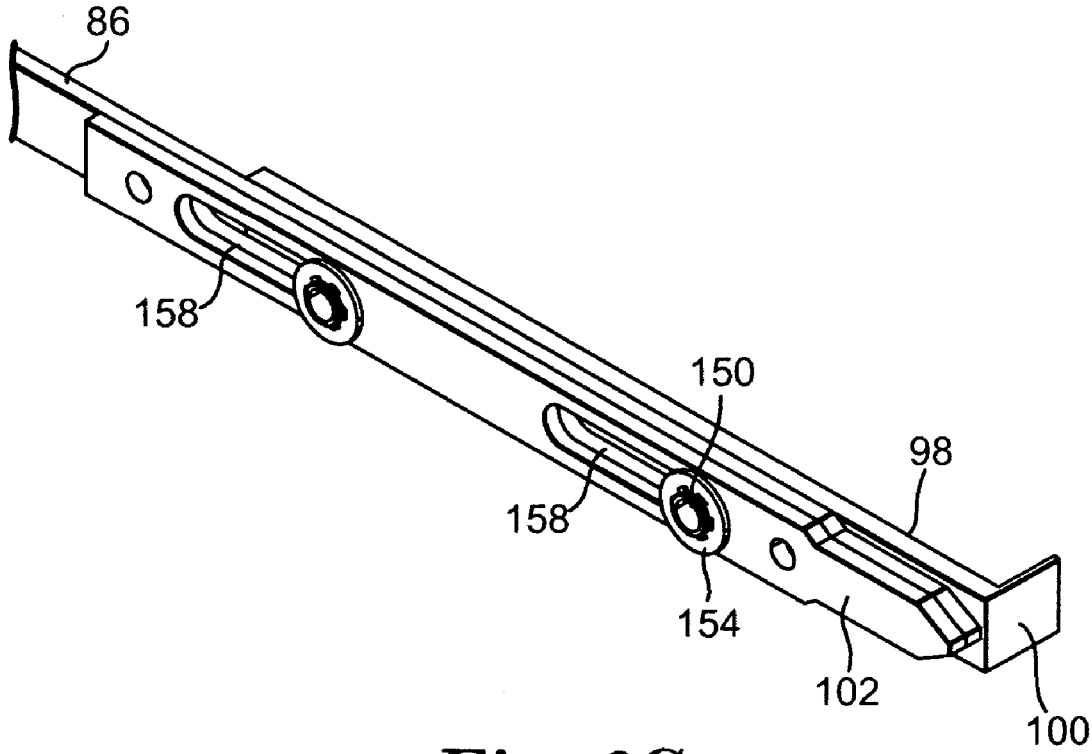
FIG. 6C is a perspective view of the distal end of the shoot bolt of FIG. 4A.

As illustrated in FIGS. 3A-B and 5, the lower shoot bolt lock 28 may include a lower shoot bolt 106 (or flush bolt) including a proximal end 108 and a distal end 110 and a first face 112 and a second face 114. The lower shoot bolt 106 may also include a plurality of spacers. A first spacer 116 may be fixedly attached to the second face 114 of the lower shoot bolt 106 at the proximal end 108. The first spacer 116 may extend some distance beyond the lower shoot bolt 106. A second spacer 118 also may be fixedly engaged on the second face 114 of the lower shoot bolt 106. Furthermore, a third spacer 120 may be slidingly secured to the distal end 110 of the lower shoot bolt 106 and the second face 114. In the present embodiment, the third spacer 120 may further include a locator 122. The distal end 110 of the lower shoot bolt 106 may further include a shoot tip 124 fixedly attached to the lower shoot bolt 106 on the first face 116. The lower shoot bolt lock 28 may also include a spring lever 126. The spring lever 126 may be secured to the proximal end 108 of the lower shoot bolt 106 and extend perpendicular to the first face 116.

Figure 7:
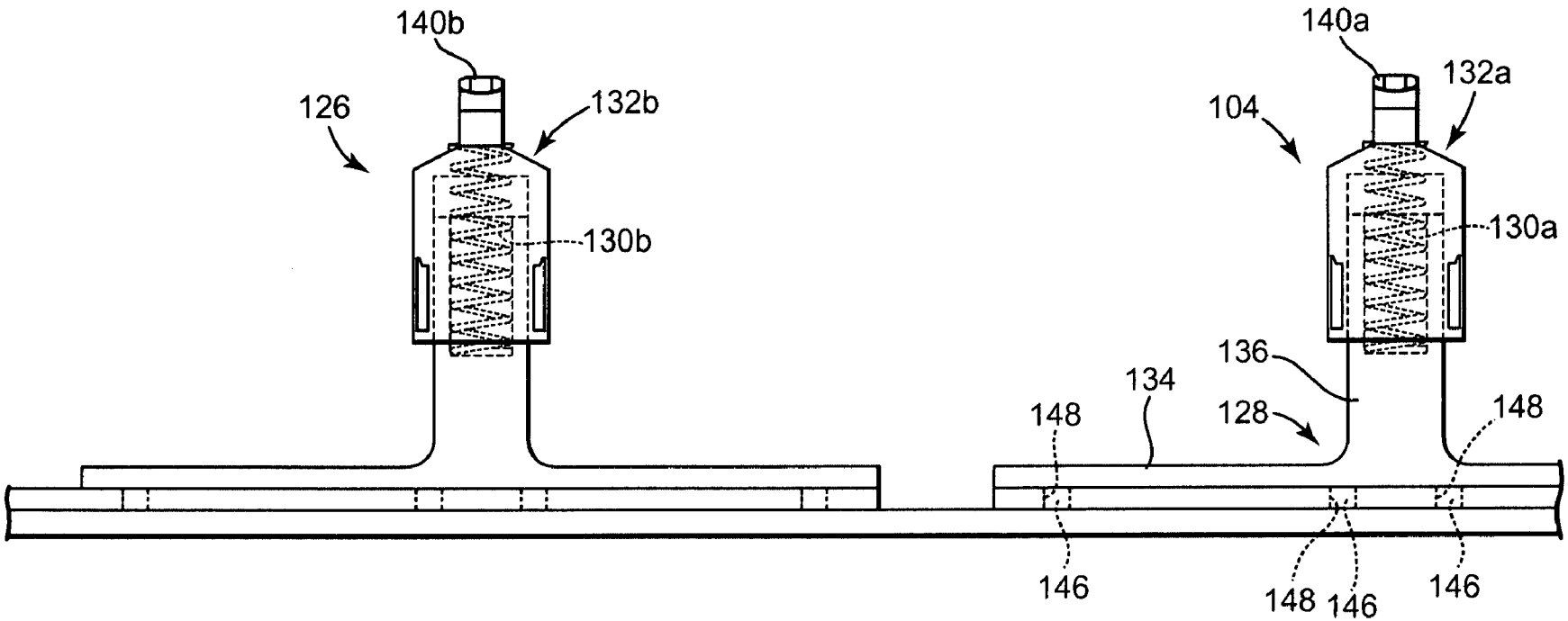
FIG. 7 is a partial side shadow view of the upper and lower shoot bolts of FIG. 2.
Figure 8:
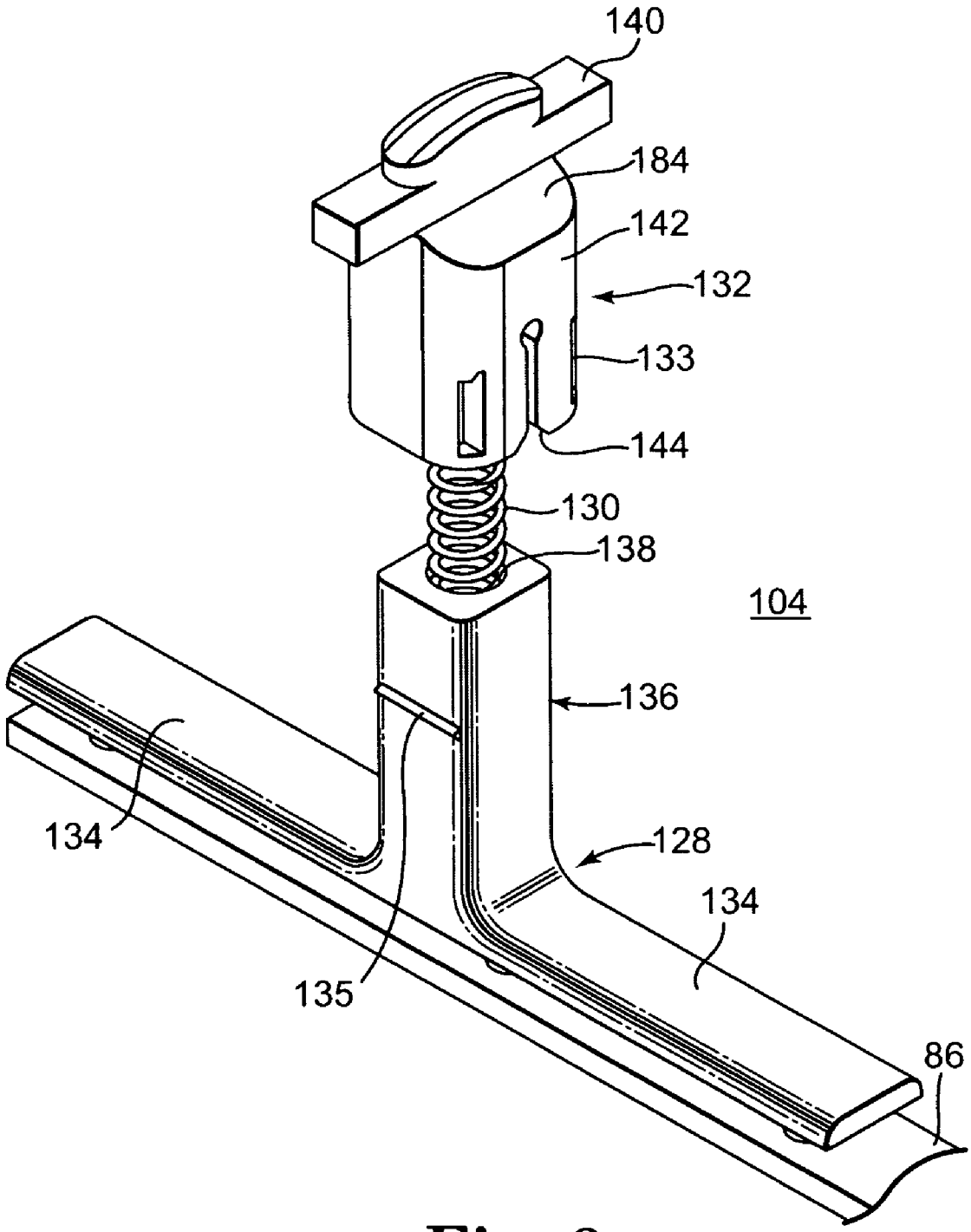
FIG. 8 is a perspective exploded view of a spring lever of the present invention.

As illustrated in FIGS. 5 and 7-8, the upper and lower shoot bolt locks 26 and 28 each include a spring lever 104 and 126 fixedly mounted on a first face 92 and 112. Since each spring lever 104 and 126 is substantially the same, only the upper spring lever 104 will be described in detail. The upper spring lever 126 may include a base 128, a spring 130, and a cap 132. The base 128 may be formed of substantially one piece and may include feet 134 and a shaft 136 connected in a substantially T-shaped formation with the shaft 136 extending generally perpendicular to the feet 134. The feet 134 and shaft 136 may be made of separate components or may be integrally formed as one piece. The shaft 136 may include a lumen 138 (or bore) through a portion and a protrusion 135. The spring 130 may be situated in the lumen 138. The cap 132 may further include a head 140 and a body 142. The head 140 may be mounted on a top end of the body 142. The body 142 may include a receiving cavity 144 and slits 133.

The spring 130 may be inserted into the lumen 138 of the shaft 136 and may extend some distance out of the top of the shaft 136. The cap 132 may placed over the spring 130 so that the spring 130 mates with the receiving cavity 144 and biases the cap 132 away from the upper shoot bolt 86 and in a substantially perpendicular direction. In the present embodiment, the cap 132 may be pressed down on the spring 130 until the cap 132 fits over the protrusion 135. The slits 133 may allow the cap 132 to expand slightly and fit over the protrusion. The protrusion 135 may mate with a corresponding protrusion (not shown) on the inside of the cap 132. The cap 132 therefore remains on the shaft 136 and keeps the spring 130 pressed into the lumen 138 with the cap constrained by the protrusion 135 (the cap 132, when constrained by the protrusion 135, is in a resting position). The protrusion 135 holds the cap 132 so that the spring 130 does not push the cap 132 off of the shaft 136. The spring 130 should exert such a force that the cap 132 returns to the resting position after being compressed. In addition, it may be desirable to have the pieces of the spring levers 104 and 126 to fit together with minimal friction to more easily allow the cap 132 to return to the resting position.

The base 128 may be made of any appropriate material, but in one embodiment is made of zinc. The spring 130 and the cap 132 may be formed of any appropriate metal or plastic material. (In the figures and when later describing the operation of the present invention, each of the upper shoot bolt lock 26 elements may be designated with an "a", i.e., spring 130*a* and cap 132*a*, and each of the lower shoot bolt lock 28 elements may be designated "b", i.e., spring 130*b* and cap 132*b*, for the sake of clarity.) The spring 130 can be any similar biasing element such as a piston.

As illustrated in FIGS. 2 and 4-7, the construction of the upper shoot bolt lock 26 will be described. The spring lever 104 may be mounted directly to the upper shoot bolt 86. In one embodiment, the base 128 includes a plurality of standoffs 146 extending from a bottom side of the base 128. The standoffs 146 may be of a size and may be spaced in a pattern to match a plurality of cutouts 148 formed in the upper shoot bolt 86. The standoffs 146 may be pressed into the cutouts 148 such that the spring lever 104 is fixedly mounted on the upper shoot bolt 86. The standoffs 146 may be made of the same material as the spring lever 104, such as zinc. In other embodiments, the spring lever 104 may be mounted to, or integrally formed as part of, the upper shoot bolt 86 in a number of ways, including screws, rivets, welding, etc.

The upper and lower shoot tips 102 and 124 and spacers 98 and 118 may be attached to the upper and lower shoot bolt 86 and 106 by placement of a plastic screw sleeve 150 through the upper and lower shoot bolt 86 and 106, shoot tip 102 and 124, and spacer 98 and 118, respectively. The screw sleeve 150 may include a sleeve shaft 152 and a corresponding washer 154. The sleeve shaft 152 of the screw sleeve 150 is first pressed through the shoot tip 102 and 124, the upper and lower shoot bolts 86 and 106, and the spacer 98 and 118. The washer 154 is then affixed to the end of the sleeve shaft 152 to hold the pieces together. The screw sleeve 150 (or sleeve shaft 152) and washer 154 may include corresponding shapes to help achieve a locking engagement between the washer 154 and the screw sleeve 150. Alternatively, other types of attaching members may be used as are known to those in the art. Moreover, the shoot tips 102 and 124 may be attached to the upper and lower shoot bolts 86 and 106 by welding, rivets, screws, etc.

The spacers 98 and 118 include a hole just big enough to allow the screw sleeve 150 to be inserted, holding the screw sleeve 150 in a stationary position relative to the spacers 98 and 118. To allow the shoot tip 102 and 124 and the upper and lower shoot bolts 86 and 106 to slide relative to the spacer 98 and 118, the upper and lower shoot bolt 86 and 106 and the shoot tip 102 and 124 may each include a channel 158 (or cut out) corresponding to each of the screw sleeves 150 inserted therein. The channels 158 may be of such a length and width as to allow the upper and lower shoot bolt 86 and 106 and corresponding shoot tip 102 and 124 to move relative to the spacer 98 and 118. The channels 158 and screw sleeve shafts 152 should be of a size to permit the sliding movement but also to retain the shoot bolts 86 and 106 in the desired position. The spacers 96, 116 and 120 also may be affixed to the upper and lower shoot bolts 86 and 106 by screw sleeves 150 and washers 154, but may also be affixed in a number of other ways, including screws, rivets, pins, welding, etc. The sliding engagement of the upper and lower shoot bolts 86 and 106 and shoot tips 102 and 124 relative to the spacers 98 and 120 may be accomplished in a number of other ways known to those in the art.

The locators 100 and 122 may correspond to some structure on the inactive door 24 (such as a groove or other slot into which the locators 100 and 122 fit) to ensure that the upper and lower shoot bolts 86 and 106 are placed in the proper position. The screw sleeve 150 utilized in the present invention is made of steel, but in alternative embodiments may be made of any material, such as Teflon™, high density polymers, or other materials useful in such an application.

The upper and lower shoot bolts 86 and 106, shoot tips 102 and 104, and other pieces of the present invention may be made of steel, hardened steel, graphite, aluminum, or some other generally durable and strong material. Because the upper and lower shoot bolts 86 and 106, and many of the other portions of the lock system 20 are not exposed, no decorative finishes are required, thus reducing the cost of the overall lock system 20. The length of the upper and lower shoot bolts 86 and 106 depends on the height of the active and inactive doors 22 and 24 and the depth of the locking points 50 and 52. The shoot tips 102 and 104 may reinforce some portion of the distal ends 90 and 110 of the upper and lower shoot bolts 86 and 106.

The spacers keep the upper and lower shoot bolts 86 and 106 and the entire lock system 20 in the proper position while being mounted on the inactive door 24. The height of the spring levers 104 and 126 should correspond to the depth of the slot in which the lock system 20 will be mounted.

Figure 9:
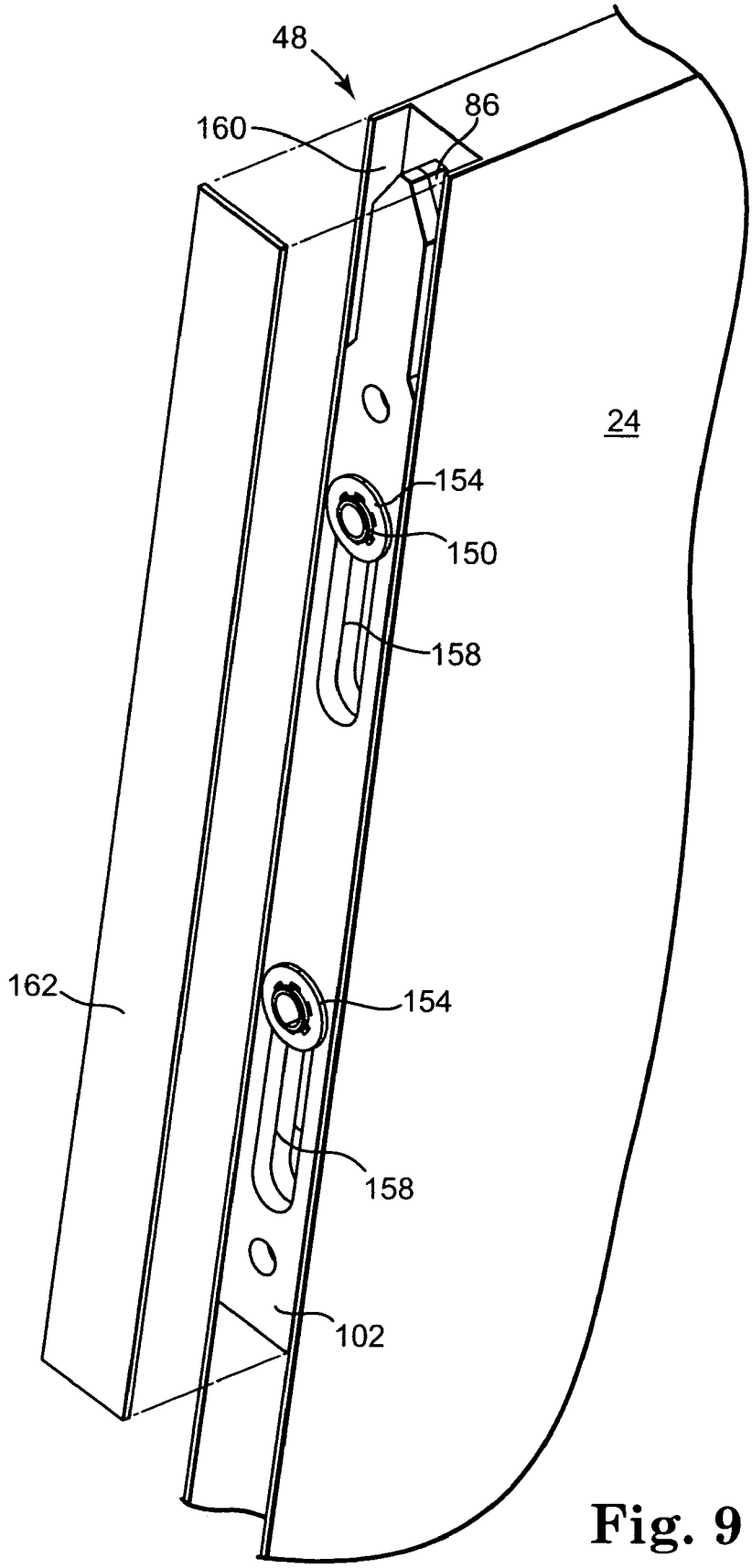
FIG. 9 is a perspective view of the shoot bolt of the present invention mounted to a door.
Figure 10:
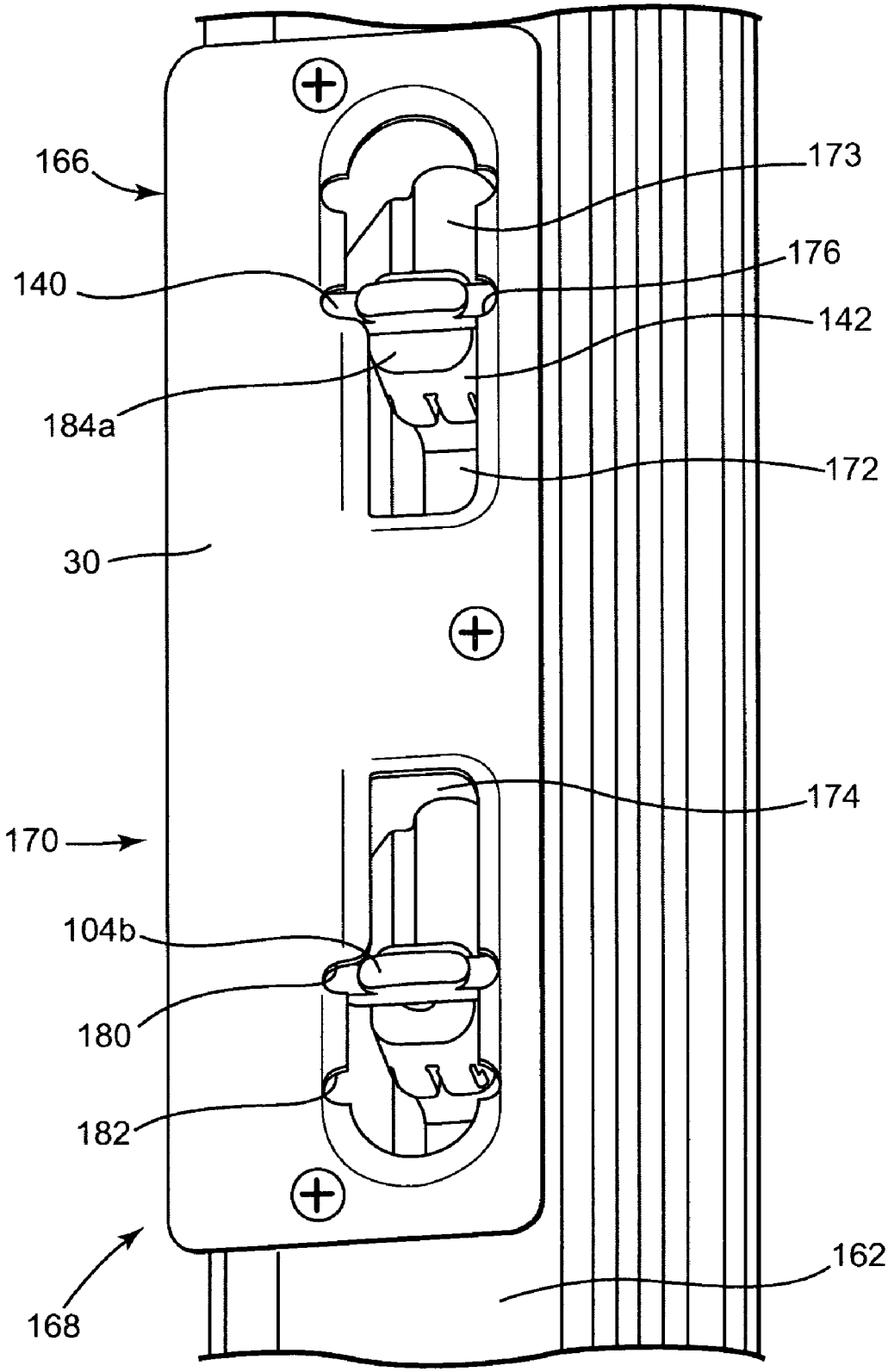
FIG. 10 is a perspective view of the strike plate area of the inactive door lock of the present invention mounted to a door.

With reference to FIGS. 9-10, a method of mounting the present invention will be described. The upper and lower shoot bolt locks 26 and 28 may be mounted in a generally U-shaped indent 160 (or depression) situated in the side edge 48 of the inactive door 24. When mounted on the inactive door 24, the proximal end 88 and 108 of the upper and lower shoot bolts 86 and 106 may be situated toward the middle of the inactive door 24. The distal end 90 and 110 of the upper and lower shoot bolts 86 and 106 may be positioned towards the top and bottom of the inactive door 24, respectively. The first face 92 and 112 of each upper and lower shoot bolt 86 and 106 may be positioned towards the active door 22 and the second face 94 and 114 towards the inactive door 24 so that the spring levers 104 and 126 face the active door 22. A cover plate 162 may substantially cover the lock system 20. In one alternative embodiment, the lock system 20 also may be mounted in or on a style or astragal.

Portions of the lock system 20 may be visible and accessible through the strike plate 30 mounted on the side edge 48 of the inactive door 24 (or on to the style or astragal, depending on the specific configuration). The strike plate 30 may be mounted using screws, fasteners, or may be integrated directly into the door, style, or astragal. The exact method for mounting the present invention on the inactive door 24 may require some changes to the dimensions of the shoot bolt locks 26 and 28, but does not effect the underlying nature of the present invention.

The width and depth of the U-shaped indent 160 should correspond to the width and depth required to receive the lock system 20 and to allow it to operate once in place. The depth of the U-shaped indentation 160 should be such that when each shoot bolt 86 and 106 is in the proper position, the cap 132 further compresses the spring 130 some amount past the resting position so that the spring 130 biases the cap 132 against the strike plate 30.

A predetermined number of pilot holes 164 (not shown) may be drilled into the side edge 48 of the inactive door 24 at several predetermined locations. The spacing of the pilot holes 164 should correspond to the desired location of the screw sleeve 50 that are to be fixed in place. The lower shoot bolt 106 may be first attached to the inactive door 24. Screws 156 may be placed through the screw sleeves 150 and into the pilot holes 162 of the inactive door 24 so that the lower shoot bolt 106 is affixed in the desired position. The spacer 118 is therefore fixed to the inactive door 24 and the shoot tip 124 and shoot bolt 106 is in sliding engagement thereto. The lower shoot bolt 106, shoot tip 124, spacers 116 and 120, etc. can move in a sliding fashion relative to the inactive door 24 and spacer 118 because of the channels 158 in the lower shoot bolt 106 and shoot tip 124. The spring lever 126 extends substantially perpendicular to the side edge 48 of the inactive door 24.

The upper shoot bolt 86 may be then placed in a similar manner such that the spring lever 104 of the upper shoot bolt 86 rests over the portion of the spacer 116 of the lower shoot bolt 106 that extends beyond the lower shoot bolt 106. The upper shoot bolt 86 is then screwed into place by placing screws 156 through the screw sleeve 150 in the upper shoot bolt 86, shoot tip 102, and spacer 98 and into the inactive door 24. After installation the upper shoot bolt 86 is likewise slidable relative to spacer 98 and inactive door 24. The cover plate 162 may then be screwed or otherwise situated over the U-shaped indentation 160. The cover plate 162 should retain the upper and lower shoot bolts 86 and 106 in an operable position. In addition, the cover plate 162 may have the strike plate 30 affixed over a portion of the cover plate 162. In alternative embodiments the strike plate 30, cover plate 162, and door, style, or astragal may be engaged in a number of different ways.

The strike plate 30 may include a first end 166, a second end 168, and a middle 170. The strike plate 30 may further include an upper opening 172 and a lower opening 174 situated near the first and second ends 166 and 168, respectively. Some portion of the upper and lower openings 172 and 174 may be of a width less than the head 140 of the cap 132. In the present embodiment a portion of the upper opening 172 is shaped to receive the deadbolt 62 and a portion of the lower opening 174 is shaped to receive the latch 78.

The upper and lower openings 172 and 174 may also each include a first detent 176 and 180 and a second detent 178 and 182 corresponding to each of the openings 172 and 174. The first detent 176 and 180 for the upper and lower openings 172 and 174 may be nearer to the middle 170 of the strike plate and may be close to that portion of the upper and lower openings 172 and 174 designed to receive the dead bolt 62 and latch 78. The second detent 178 and 182 may be nearer to the first and second ends 166 and 168 of the strike plate 30. Each detent is of a size and shape to releasably capture or secure the head 140 of the cap 132 which may be biased against a back side of the strike plate 30 by the spring 130.

The head 140 of each of the caps 132*a* and 132*b* of the upper and lower spring levers 104 and 126 may be received in either the first detent 176 and 180 or second detent 178 and 182 and also movable between the same. Movement of the heads 140*a* and 140*b* and the spring levers 104 and 126 from one detent to another may move the shoot bolts 86 and 106 a corresponding amount. The distance between the first detent 176 and 180 and the second detent 178 and 182 corresponds to the same distance required to move the upper and lower shoot bolts 86 and 106 into locking engagement with the upper and lower locking points 50 and 52. The first detent 176 and 180 may correspond to the unlocked position for both the upper and lower shoot bolts 86 and 106. In other words, the distal ends 90 and 110 of the shoot bolts 86 and 106 are not engaged to the upper and lower locking points 50 and 52.

In order to engage the shoot bolts 86 and 106 with the locking points 50 and 52, springs 130*a* and 130*b* may be compressed by pushing the heads 140*a* and 140*b* inwards. The springs 130*a* and 130*b* are compressed into the receiving cavities 144*a* and 144*b* of the caps 132*a* and 132*b* along the angle the springs 130*a* and 130*b* are mounted inside the lumen 138*a* and 138*b* of the shaft 136 and 136*b*. The caps 132*a* and 132*b* are therefore disengaged from the first detent 176 and 180. The caps 132*a* and 132*b*, spring levers 104 and 126, and upper and lower shoot bolts 86 and 106 may be then moved to where the second detent 178 and 182 receives the heads 140*a* and 140*b* of the caps 132*a* and 132*b*. The second detent 178 and 182 may be positioned at a distance from the first detent 176 and 180 such that when the caps 132*a* and 132*b* engage the second detent 178 and 182, the upper and lower shoot bolts 86 and 106 actively engage the upper and lower locking points 50 and 52. The upper and lower shoot bolt locks 26 and 28 are therefore engaged in a locked position.

When spring levers 104 and 126 are in the first detent position 176 and 180, a shoulder 184*a* and 184*b* of each cap 132*a* and 132*b* may be in that area of the upper and lower openings 172 and 174 meant for receiving the dead bolt 62 and the latch 78. The shoulder 184 of each cap 132*a* and 132*b* may be in a position whereby the engagement of the dead bolt 62 and the latch 78 is blocked. Therefore, when the active door 22 is closed and brought into operational proximity with the inactive door 24, the active door lock 58 can not be moved to a locked position. To allow the dead bolt 62 and latch 78 to engage the strike plate 30, the caps 132*a* and 132*b* must be moved to the second detent 178 and 182. Moving the caps 132*a* and 132*b* also moves the spring levers 104 and 126 along with the corresponding upper and lower shoot bolts 86 and 106.

The active door lock 58 therefore can not be locked unless the inactive door lock 80 (including the upper shoot bolt lock 26 and the lower shoot bolt lock 28) is engaged in a locked position. In alternative embodiments, the first detent 176 and 180 may be at or near the middle of the upper and lower openings 172 and 174 shaped to receive the dead bolt 62 or latch 78.

In one alternative embodiment, the spring lever 104 and 126 may be replaced by other means for engaging a detent known to those skilled in the art. For example, the spring may be replaced by a piston. In still further embodiments, the spacers may be replaced by rollers, springs, etc. In yet another embodiment, the active door lock may only include a dead bolt or latch bolt and so the inactive door lock only blocks that one locking device from engagement.

In still further embodiments, the spring levers 104 and 126 may not be the element that blocks the strike plate 30 from receiving the dead bolt 62 or latch 78. The upper and lower shoot bolts 86 and 106 may have some other blocking element for preventing the engagement separate from the lever element utilized to move the upper and lower shoot bolts 86 and 106 from an unlocked to a locked position.

With regard to the foregoing description, it is to be understood that changes may be made in the details, without departing from the scope of the present invention. It is intended that the specification and depicted aspects be considered exemplary only, with a true scope and spirit of the invention being indicated by the broad meaning of the following claims.

What is claimed is:

1. A door system comprising:

a frame defining a doorway, the frame including an active door, an inactive door having a strike plate with at least one receiving area, and a first locking point;

a first lock attached to the inactive door, the first lock including:

a first shoot bolt in sliding engagement with the inactive door, and a selectably positionable lever including a shaft, a cap, and a spring, a distal end of the spring mounted in the shaft and a proximal end of the spring engaging the cap to bias the cap against the strike plate, wherein the selectably positionable lever is attached to the first shoot bolt and the first shoot bolt has a first unlocked position and a second locked position, and wherein in the second locked position the first shoot bolt engages the first locking point; and a second lock attached to the active door, the second lock including an unlocked position and a locked position in the receiving area, the selectably positionable lever blocking the second lock from moving into the receiving area to the locked position unless the first shoot bolt is in the second locked position.

2. The door system of claim 1 wherein the second lock further comprises a dead bolt and a latch, the dead bolt and the latch extensible from a first retracted to a second extended position, the first lock including a second shoot bolt having a first unlocked position and a second locked position, and the frame including a second locking point.

3. The door system of claim 1, wherein the strike plate includes a first receiving area and a second receiving area, the first receiving area shaped to receive a dead bolt and the second receiving area shaped to receive a latch; and a second lever attached to a second shoot bolt, whereby when the first shoot bolt is in the first unlocked position, the first lever prevents the first receiving area from receiving the dead bolt and when the second shoot bolt is in the first unlocked position, the second lever prevents the second receiving area from receiving the latch.

4. The door system of claim 3 wherein the first and second blocking elements are spring levers.

5. The lock system of claim 1 wherein first and second shoot bolt further comprise a first and second shoot tip.

6. The lock system of claim 1 wherein the first and second shoots bolt further comprises at least one spacer.

7. The lock system of claim 3 wherein each of the first and second levers comprises a shaft, a cap, and a spring, a distal end of the spring mounted in the shaft and a proximal end of the spring engaging the cap to bias the cap against the strike plate.

8. The lock system of claim 7 wherein the first receiving area includes a first detent and a second detent and the second receiving area includes a first detent and a second detent, the cap of the first lever selectably positionable in the first detent and the second detent whereby when the cap of the first lever is in the first detent the first receiving area is prevented from receiving the dead bolt and when the first lever is in the second detent the first receiving area can receive the dead bolt, the cap of the second lever selectably positionable in the first detent and the second detent whereby when the second lever is in the first detent the second receiving area is prevented from receiving the latch and when the cap of the second lever is in the second detent the second receiving area can receive the latch.

9. A lock system for securing a first and second door, the first and second door each mounted for movement between an open and a closed position, the lock system comprising:

a first door lock including a latch, the latch extensibly mounted to the first door such that the latch is moveable between a first retracted position and a second extended position;

a strike plate mounted to the second door such that when the first and second doors are in the closed position, and wherein when the latch is in the second extended position, the strike plate receives the latch in a receiving area; and a second door lock operably attached to the second door, the second door lock including a shoot bolt and a lever operably attached to the shoot bolt such that the shoot bolt is moveable along with the lever from a first unlocked position to a second locked position wherein when the first and second door are in the closed position the latch cannot be moved to the second extended position unless the shoot bolt is in the second locked position because when the shoot bolt is in the first unlocked position the lever is positioned to prevent the receiving area from receiving the latch, wherein the lever includes a shaft, a cap, and a spring engaging the cap to bias the cap against the strike plate.

10. The lock system of claim 9 wherein when the shoot bolt is in the second locked position the lever is positioned to allow the strike plate to receive the latch.

11. The lock system of claim 9 wherein the shoot bolt further comprises a shoot tip.

12. The lock system of claim 9 wherein the shoot bolt further comprises one or more spacers.

13. The lock system of claim 9 wherein a distal end of the spring is mounted in the shaft with a proximal end of the spring engaging the cap to bias the cap against the strike plate.

14. The lock system of claim 13 wherein the strike plate includes a first detent and a second detent, the cap of the lever selectably positionable in the first detent and the second detent whereby when the cap is in the first detent the shoot bolt is in the first unlocked position and when the cap is in the second detent the shoot bolt is in the second locked position.

15. The lock system of claim 14 further comprising:

a dead bolt, the deadbolt extensibly mounted to the first door such that the dead bolt is moveable between a first retracted position and a second extended position; and a second shoot bolt, the second shoot bolt including a second lever, the second shoot bolt moveable from a first unlocked position to a second locked position wherein when the first and second door are in the closed position the dead bolt cannot be moved to the second extended position unless the second shoot bolt is in the second locked position.

16. A door lock system comprising:

a first lock including a latching member for engaging a strike plate, the strike plate including a shaped cutout, the shaped cutout including an area for receiving the latching member, a first detent, and a second detent;

a second lock including a shoot bolt, the shoot bolt including a lever having a shaft, a cap, and a spring biasing the cap against a back side of the strike plate such that the lever is positionable in the first detent or the second detent, wherein when the lever is in the first detent the shoot bolt is in a first retracted position, wherein when the lever is in the second detent the shoot bolt is in the second extended position, and whereby when the lever is in the first detent position the latching member is prevented from engaging the strike plate and whereby when the lever is in the second detent position the latching member can engage the strike plate; wherein the first lock is attached to an active door and the second lock is attached to an inactive door, the active door and the inactive door hung in a double door set.

17. The door lock system of claim 16 wherein when the shoot bolt is in the second extended position a distal end of the shoot bolt lockingly engages a locking point.

18. The door lock system of claim 17 wherein the shoot bolt includes a shoot tip fixedly attached to a distal end of the shoot bolt.

19. The door lock system of claim 16 wherein the shoot bolt includes one or more spacers that ensure the correct alignment of the shoot bolt with the locking point.

20. The door lock system of claim 16 wherein latching member is a dead bolt.

21. The door lock system of claim 16 wherein the latching member is a latch.

22. A door lock system comprising:

an inactive door and an active door pivotally mounted in a frame wherein when the inactive door and the active door are in a closed position a side edge of the active door is in an operable position relative to a side edge of the inactive door;

an active door lock attached to the side edge of the active door, the active door lock including an engagement member, the engagement member having a first retracted position and a second extended position;

a strike plate affixed to the side edge of the inactive door, the strike plate having a receiving area formed in the strike plate, the strike plate receiving the engagement member in the receiving area when the active door and the inactive door are in the closed position and the engagement member is in the extended position;

an inactive door lock attached to the side edge of the active door, the inactive door lock including a first shoot bolt and a second shoot bolt, each first and second shoot bolt having a first unlocked position and a second locked position; and means slidably received in the receiving area of the strike plate and attached to the inactive door lock for preventing the strike plate from receiving the engagement member when one or more of the first and second shoot bolts are in the first unlocked position, the means including a shaft, a cap, a spring biasing the cap against the strike plate.

23. The door lock system of claim 22 wherein the first and second shoot bolts include a first and second spring lever, respectively the first and second spring levers being in a position to prevent the strike plate from receiving the first and second engagement members when the first and second shoot bolts are in the first unlocked position.

* * * * *